United States Patent [19]

So

[11] Patent Number: 4,495,036

[45] Date of Patent: Jan. 22, 1985

[54] ELECTROCHEMICAL CHLORINATION PROCESS

[75] Inventor: Ying-Hung So, Midland, Mich.

[73] Assignee: The Dow Chemical Company, Midland, Mich.

[21] Appl. No.: 512,263

[22] Filed: Jul. 11, 1983

[51] Int. Cl.[3] ..... C25C 1/00

[52] U.S. Cl. ..... 204/59 R

[58] Field of Search ..... 204/59 R

[56] References Cited

U.S. PATENT DOCUMENTS

| | | | |
|---|---|---|---|
| 4,013,730 | 3/1977 | Graham | 260/650 R |
| 4,024,198 | 5/1977 | Buckholtz | 570/209 |
| 4,031,142 | 6/1977 | Graham | 570/209 |
| 4,031,147 | 7/1977 | Graham | 570/209 |
| 4,069,263 | 1/1978 | Lin | 570/209 |
| 4,069,264 | 1/1978 | Lin | 570/209 |
| 4,250,122 | 2/1981 | Lin | 570/209 |
| 4,269,674 | 5/1981 | Osa | 204/81 |

FOREIGN PATENT DOCUMENTS

| | | |
|---|---|---|
| 1153746 | 5/1969 | United Kingdom . |
| 1163927 | 9/1969 | United Kingdom . |

OTHER PUBLICATIONS

Cohen et al., J. Chem. Soc., V. 87, pp. 1034–1037 (1905).

Gourcy et al., Electrochimica Acta, V. 24, pp. 1039–1946 (1979).

Stock & Himoe, Tetrahedron Lett., V. 1960, pp. 9–13 (1960).

Chemical Abstracts—94:216524n.

Chemical Abstracts—92:101403p.

Chemical Abstracts—95:203165e.

Derwent 90175d.

*Primary Examiner*—John F. Niebling

*Attorney, Agent, or Firm*—Paul D. Hayhurst

[57] ABSTRACT

Electrolytically prepare para-chloroalkyl aromatic compounds, such as para-chlorotoluene, using a potential of less than 1.5 volts, as measured against a Ag/Ag+ reference electrode, and an anode which is free of cyclodextrin.

20 Claims, No Drawings

ELECTROCHEMICAL CHLORINATION PROCESS

BACKGROUND OF THE INVENTION

The present invention relates to the electrolytic chlorination of alkyl aromatic compounds to produce para-chloroalkyl aromatic compounds.

Para-chloroalkyl aromatic compounds generally are useful intermediates in the production of organic chemicals, and are especially important intermediates in the production of certain biologically active compounds.

Alkyl aromatic compounds have been monochlorinated electrolytically in the past. Gourcy et al. in *Electrochimica Acta,* Vol. 24, 1039–1046 (1979), report the anodic chlorination of benzene and its methyl-substituted derivatives in acetonitrile/$LiClO_4$ electrolyte using a platinum anode. The chlorinating salt was LiCl or tetraethyl ammonium chloride. At page 1040, it is taught that: "In the case of toluene, the orthochloro derivative is formed in preference to the parachloro derivative." This conclusion was reached from the observation of experimental runs in which the potential was 1.5 volts or higher.

Higher para-chloro/ortho-chloro (hereinafter p/o) ratios are achieved using the process of U.S. Pat. No. 4,269,674. Said process is disadvantageous in that it operates at very low conversions, and requires an anode of a carbonaceous material having cyclodextrin or a derivative thereof bonded onto the surface of the anode. These exotic cyclodextrin-containing electrodes are disadvantageous in that their preparation involves several steps and the electrodes have a limited useful life. Consequently, it would be expensive to use the cyclodextrin-containing electrodes in a commercial process.

In view of the deficiencies of the electrolytic chlorination methods of the prior art, it would be desirable to have a process to produce monochlorinated alkyl aromatic compounds at good conversions and with high p/o ratios using standard, readily available electrodes.

SUMMARY OF THE INVENTION

The present invention is an improved process for the production of monochlorinated aromatic compounds. The process comprises electrolytically chlorinating a compound of formula I:

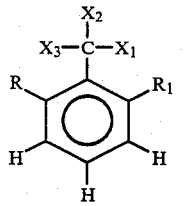

I wherein R is H or alkyl; $R_1$ is H, an electron-withdrawing moiety or a weak electron-donating moiety; and $X_1$, $X_2$ and $X_3$ are independently H, halo, alkyl or haloalkyl; in an electrolytic solution of a primary cyano alkane solvent by passing from an anode, which has a surface which is substantially free of cyclodextrin or derivatives which has a potential which is higher than the oxidation potential of HCl in the electrolytic solution but is lower than the oxidation potential of the compound of formula I, and under reaction conditions such that there is formed a compound of formula II:

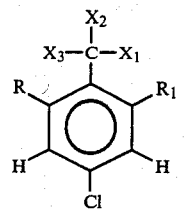

II wherein R, $R_1$, $X_1$, $X_2$ and $X_3$ are as defined hereinabove.

Surprisingly, the process of the present invention produces compounds of formula II in good conversions using standard electrodes. Interestingly, a high ratio of para to ortho substitution, with reference to the position of the $—CX_1X_2X_3$ moiety, is achieved. The compounds of formula II generally are useful as intermediates in the synthesis of valuable chemicals.

DETAILED DESCRIPTION OF THE INVENTION

The alkyl aromatic compounds which are suitable for use in the process of the present invention include compounds represented generally by the formula:

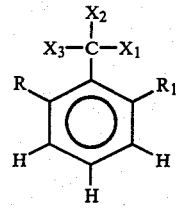

I wherein R is H or alkyl; $R_1$ is H, an electron-withdrawing moiety or a weak electron-donating moiety; and $X_1$, $X_2$ and $X_3$ are independently H, halo, alkyl or haloalkyl. Preferably, R is H, lower alkyl, nitro, cyano or lower haloalkyl. Preferred $R_1$ moieties include lower alkyl and H. It is preferred that $X_1$, $X_2$ and $X_3$ be H, halo, lower alkyl or lower haloalkyl. More preferably, R and $R_1$ are H. Examples of the more preferred alkyl aromatic compounds include toluene, ethylbenzene, benzyl chloride, benzyl cyanide, benzotrifluoride and benzotrichloride. Toluene is the most preferred alkyl aromatic compound.

An electrolytic solution is employed in the process of the present invention. The electrolyte generally comprises a solvent, and an electrolytic salt which is a source of chlorine atoms. The electrolytic solution preferably is anhydrous.

The solvent employed in the process of the present invention serves to solubilize the electrolytic salt and should be selected to give a higher p/o ratio in the alkyl aromatic product. Preferred solvents include the primary cyano alkyl compounds such as, for example, acetonitrile (ethane nitrile, methyl cyanide), propane nitrile, butane nitrile and the like. Acetonitrile and propane nitrile are the preferred solvents, with acetonitrile being most preferred. Mixtures of solvents may be employed.

The electrolytic salt employed in the process of the present invention serves as a source of chloride ions. The electrolytic salt should be soluble in the solvent and exhibit high electrical conductivity when employed in the electrolytic solution. Typical electrolytic salts include inorganic chloride salts and dry HCl. Preferred electrolytic salts are the chlorides of the alkaline earth metals and the alkali metals. LiCl is the most preferred electrolytic salt. Mixtures of electrolytic salts may be employed.

The electrolytic salt may be employed alone or in conjunction with any known supporting electrolytic salt in the preparation of the electrolytic solution. Typical supporting electrolytic salts include $LiClO_4$ and tetraalkyl ammonium salts. The supporting electrolytic salt should be soluble in the solvent and should exhibit high electrical conductivity in the electrolytic solution. The supporting electrolytic salt preferably is inert with respect to the alkyl aromatic compounds employed in the process of the present invention.

Advantageously, the electrolytic salt is employed in an amount which is sufficient to allow the flow of electric current through the electrolytic solution. The concentration of the electrolytic salt(s) in the solvent typically is from about 0.05 mole/liter of solvent up to a point at which the electrolytic solution is saturated. Supersaturated solutions may be employed if desired. Preferably, from about 0.1 to about 1 mole of electrolytic salt is employed per liter of solvent. Typically, the electrolytic solution is employed in an amount which is sufficient to allow the flow of electric current from an anode to a cathode in an electrolytic cell.

The process of the present invention may employ standard electrodes and peripheral equipment. The electrodes may be constructed of any materials which allow the reaction to proceed. The cathode may be made of, for example, stainless steel, graphite, mercury, lead, platinum, gold and the like. For the sake of convenience, it is preferred to employ a cathode of carbon or stainless steel. Suitable examples of materials which may be used to construct the anode include the metals or metal oxides of such metals as titanium, lead and platinum. Preferably, the anode is constructed of a metal-containing material and has a surface which is substantially free of cyclodextrin or derivatives of cyclodextrin. More preferably, the anode has a metal-containing surface, the metals being selected from gold, silver, platinum, palladium, iridium, rhodium, ruthenium and osmium. The anode may include a material which is coated to give a surface which is a metal or a metal oxide.

In the practice of the process of the present invention, an electric current is supplied between the electrodes, which are placed in an electrolytic cell which typically is divided into two sections by a glass frit or a membrane. Typically, the potential applied to the anode is higher than the oxidation potential of dry HCl or of the electrolytic salt which is the source of the chloride ions, and is lower than the oxidation potential of the alkyl aromatic compound or the para-chlorinated alkyl aromatic product. When a silver metal/$Ag^+$ electrode is used as the reference electrode, the anode potential is typically less than about 1.5 volts, is preferably from about 0.7 to about 1.3 volts, and most preferably is from about 1.0 to about 1.1 volts. The magnitude of the electrical current is governed by practical considerations such as cell resistance and the size of the electrodes employed.

The process of the present invention may be performed at temperatures ranging from about −40° C. up to just below the boiling point of the electrolytic solution. Typically, the process temperature is from about −40° C. to about 40° C. Preferably, the temperature is from about −20° C. to about ambient temperature, with temperatures at the lower end of this range being favored. The process of the present invention may be performed at any pressure at which the reaction will proceed, however, it is most convenient to operate the process at ambient pressure.

When the process of the present invention is conducted according to the method described hereinbefore, a product is produced which is represented generally by the formula:

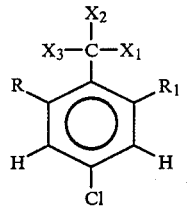

II wherein R, $R_1$, $X_1$, $X_2$ and $X_3$ are as defined hereinabove. For the purposes of the present invention, the compound of formula II is the para-chloro isomer. The ratio of para-chloro isomer to ortho-chloro isomer is the p/o ratio. Typically, the process of the present invention produces a product mixture with a p/o ratio which is greater than one. Preferably, the p/o ratio is greater than about 1.7.

The reaction time varies depending on the amount of alkyl aromatic compound employed and the strength of the current. Typically, the reaction is complete after about 2 Faradays per mole of alkyl aromatic compound have been passed through the electrolytic cell. The product may be recovered from the anode solution by any conventional means such as, for example, extraction or distillation.

SPECIFIC EMBODIMENTS

The following examples and comparative experiments are given to illustrate the invention and should not be construed as limiting its scope.

EXAMPLE 1

Electrolysis is performed in an electrolytic cell equipped with a glass frit to separate the cell into a cathode compartment and an anode compartment. The cell is placed in a bath of ice water having a fairly constant temperature of about 0° C. The anode is a 2 $cm^2$ sheet of platinum and the cathode is stainless steel. The anode compartment is filled with 100 ml of acetonitrile, 200 mg of LiCl, 4.7 mmoles of toluene and enough tetraethyl ammonium fluoroborate (TAF) to make the concentration of the TAF 0.1 molar. The cathode compartment contains 60 ml of acetonitrile, and enough TAF to make the concentration of the TAF 0.1 molar.

All acetonitrile is distilled over $P_2O_5$ before it is placed in the cell. All glassware, LiCl, and TAF are dried in an oven before use.

Electrolysis is performed at 1.1 volts relative to a Ag/$Ag^+$ (0.01 molar in acetonitrile) reference electrode. Electrolysis is stopped after passing through the cell 2 Faradays per mole of toluene initially present. About 80 percent of the acetonitrile from the anode compartment is distilled away, and the residue is treated with dichloromethane and water. The organic layer is recovered and then dried, and the solvents are distilled away. The composition of the remaining mixture is analyzed using gas chromatographic means and is as follows:

p-chlorotoluene: 36 mole percent
o-chlorotoluene: 16 mole percent
unreacted toluene: 47 mole percent Thus, the p/o ratio is 36/16=2.25.

COMPARATIVE EXPERIMENTS

The procedure of Example 1 is repeated except that acetonitrile is replaced with a different solvent. The results are reported in Table I.

TABLE I

| Solvent | p/o ratio |
|---|---|
| dimethylformamide | 0.77 |
| dimethylacetamide | 0.66 |
| methanol | 1.00 |

Thus, it may be observed that the solvents employed in the comparative experiments do not achieve p/o ratios greater than one. Since para-chlorotoluene is more valuable than ortho-chlorotoluene, it is clearly advantageous to employ a primary cyano alkane solvent in the process of the present invention.

EXAMPLE 2

The procedure of Example 1 is repeated except that 9.2 mmoles of toluene is employed and the temperature of the bath is −20° C. The composition of the final mixture is as follows (in mole percent):

| | |
|---|---|
| p-chlorotoluene | 15.5 |
| o-chlorotoluene | 5.4 |
| unreacted toluene | 74.5 |
| | 95.4 |

Thus, the p/o ratio is 2.87.

EXAMPLE 3

The procedure of Example 2 is repeated except that no TAF is employed, i.e., LiCl is the sole electrolyte in both compartments, and only 0.13 Faradays are passed per mole of toluene initially present. The composition of the final mixture is not determined, but the p/o ratio is 3.0.

Among other things, Examples 2 and 3 demonstrate the advantage of low process temperature in the process of the present invention.

As previously mentioned, the preceding examples and comparative experiments serve only to illustrate the invention and its advantages, and they should not be interpreted as limiting since further modification of the disclosed invention will be apparent to those skilled in the art. For example, the process of the present invention may be performed in a continuous manner. All such modifications are deemed to be within the scope of the invention as defined by the following claims.

What is claimed is:

1. A process comprising electrolytically chlorinating an alkyl aromatic compound of Formula I:

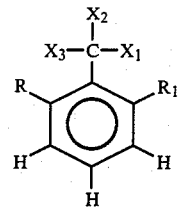

I wherein R is H or alkyl; $R_1$ is H, a weak electron-donating moiety or an electron-withdrawing moiety; and $X_1$, $X_2$ and $X_3$ are independently H, halo, alkyl, or haloalkyl; in an electrolytic solution comprising a primary cyano alkane solvent and dry HCl or an electrolytic salt, which is a chloride salt of an alkali metal or an alkaline earth metal, by passing from an anode, which has a surface which is substantially free of cyclodextrin or derivatives thereof, to a cathode an electric current under reaction conditions such that there is formed a compound of formula II:

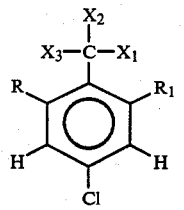

II wherein R, $R_1$, $X_1$, $X_2$ and $X_3$ are as defined for formula I, with the proviso that the ratio of compound II formed to the corresponding ortho-chloro isomer formed is at least about 1.7.

2. The process of claim 1 wherein the primary cyano alkane solvent comprises acetonitrile or propane nitrile.

3. The process of claim 2 wherein the potential is less than about 1.5 volts measured againt a $Ag/Ag^+$ reference electrode.

4. The process of claim 3 wherein the solvent is acetonitrile.

5. The process of claim 4 wherein the potential is from about 0.7 to about 1.3 volts.

6. The process of claim 5 wherein R and $R_1$ are H.

7. The process of claim 6 wherein the potential is from about 1.0 to about 1.1 volts.

8. The process of claim 7 wherein toluene is the compound of formula I and para-chlorotoluene is the compound of formula II.

9. The process of claim 1 wherein $R_1$ is H, nitro, cyano, lower alkyl or lower haloalkyl.

10. A process for the electrolytic preparation of para-chlorotoluene from toluene comprising contacting toluene with an electrolytic solution comprising dry HCl or an electrolytic salt which is an alkali metal chloride or an alkaline earth metal chloride, in a primary cyano alkane solvent, and passing an electric current from an anode, which has a potential of less than about 1.5 volts, measured against a $Ag/Ag^+$ reference electrode, the anode having a surface which is substantially free of cyclodextrin or derivatives of cyclodextrin, to a cathode through the electrolytic solution such that the ratio of para-chlorotoluene to ortho-chlorotoluene is at least about 1.7.

11. The process of claim 10 wherein at least one of $X_1$, $X_2$ and $X_3$ is a chlorine atom.

12. The process of claim 10 wherein the potential is from about 0.7 to about 1.3 volts.

13. The process of claim 12 wherein the electrolytic salt is LiCl.

14. The process of claim 13 wherein a tetraalkyl ammonium salt or $LiClO_4$ is employed as a supporting electrolyte.

15. The process of claim 13 wherein the potential is from about 1.0 to about 1.1 volts.

16. The process of claim 15 wherein the solvent comprises acetonitrile.

17. A process for the preparation of para-chlorotoluene comprising electrolytically chlorinating toluene by passing an electric current from an anode, which has a potential of from about 0.7 to about 1.3 volts as measured against a $Ag/Ag^+$ reference electrode, the anode having a surface which is substantially free of cyclodextrin or derivatives of cyclodextrin, to a cathode, the current passing through an electrolytic solution comprising toluene, LiCl and $LiClO_4$ or a tetraalkyl ammonium salt, and, as a solvent, acetonitrile under reaction conditions such that the ratio of para-chlorotoluene to ortho-chlorotoluene is at least about 1.7.

18. The process of claim 17 wherein the electric current has a potential of from about 1 to about 1.1 volts.

19. The process of claim 1 wherein $X_1$, $X_2$ and $X_3$ are halo, lower alkyl, or lower haloalkyl.

20. The process of claim 1 wherein the ratio of para-chlorotoluene to ortho-chlorotoluene is at least about 2.25.

* * * * *

UNITED STATES PATENT AND TRADEMARK OFFICE

CERTIFICATE OF CORRECTION

PATENT NO. : 4,495,036

DATED : January 22, 1985

INVENTOR(S) : Ying-Hung So

It is certified that error appears in the above-identified patent and that said Letters Patent is hereby corrected as shown below:

On the patent title page, under OTHER PUBLICATIONS, "1039-1946" should be -- 1039-1046 --.

Column 1, line 65, insert -- thereof, to a cathode an electric current -- after the word derivatives.

Column 1, lines 66-68, and Column 2, line 1, should be deleted, beginning after current: "which has a potential which is higher than the oxidation potential of HCl in the electrolytic solution but is lower than the oxidation potential of the compound of formula I,".

Column 6, line 40, "againt" should read -- against --.

Signed and Sealed this

Ninth Day of July 1985

[SEAL]

*Attest:*

DONALD J. QUIGG

*Attesting Officer* *Acting Commissioner of Patents and Trademarks*